US007233675B2

(12) United States Patent
Kajihara et al.

(10) Patent No.: US 7,233,675 B2
(45) Date of Patent: Jun. 19, 2007

(54) METHOD OF FORMING AN ELECTRET CONDENSER MICROPHONE

(75) Inventors: Kazuhiko Kajihara, Yokohama (JP); Tooru Himori, Sagamihara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/367,128

(22) Filed: Mar. 3, 2006

(65) Prior Publication Data

US 2006/0143911 A1 Jul. 6, 2006

Related U.S. Application Data

(62) Division of application No. 10/139,588, filed on May 3, 2002, now Pat. No. 7,062,052.

(30) Foreign Application Priority Data

May 10, 2001 (JP) ..... 2001-140495

(51) Int. Cl.
*H04R 25/00* (2006.01)
*H04R 31/00* (2006.01)

(52) U.S. Cl. ..... 381/174; 29/594

(58) Field of Classification Search ..... 29/17.1, 29/17.2, 594, 597; 381/174, 191; 367/170
See application file for complete search history.

(56) References Cited

U.S. PATENT DOCUMENTS 4,764,690 A * 8/1988 Murphy et al. ..... 381/191
6,684,484 B2 * 2/2004 Collins ..... 29/594
6,694,032 B2 * 2/2004 Yun et al. ..... 29/594
2002/0071579 A1 6/2002 Himori et al. ..... 381/113

FOREIGN PATENT DOCUMENTS

JP 2000-050393 2/2000
JP 2001-099860 4/2001

* cited by examiner

*Primary Examiner*—Sinh Tran
*Assistant Examiner*—Brian Ensey
(74) *Attorney, Agent, or Firm*—Pearne & Gordon LLP

(57) ABSTRACT

An electret condenser microphone includes a casing member, a circuit board disposed in the casing member, an electrically insulating member disposed on the circuit board and having an outer surface opposing and spaced apart from the casing member, and an inner surface defining a central opening, an electrode plate mounted on the electrically insulating member, a plurality of electrically connecting members each intervening between the circuit board and the electrode plate to have the circuit board and the electrode plate electrically connected with each other, each of the electrically connecting members having a first portion disposed along the inner surface of the electrically insulating member, a second portion integrally formed with the first portion and radially outwardly extending from one end of the first portion, and a third portion integrally formed with the first portion and radially outwardly extending from the other end of the first portion, and a diaphragm disposed along the electrode plate and spaced apart from the electrode plate at a predetermined space distance.

1 Claim, 9 Drawing Sheets

METHOD OF FORMING AN ELECTRET CONDENSER MICROPHONE

BACKGROUND OF THE INVENTION

1. Field of the Invention

The present invention relates to an electret condenser microphone available for various audio equipments such as a cellular phone, and more particularly to an electret condenser microphone equipped with a capacitor unit constituted by an electrode plate and a diaphragm to receive an acoustic wave to be converted to an acoustic signal indicative of the acoustic wave.

2. Description of the Related Art

Up until now, there have been proposed a wide variety of conventional electret condenser microphones each equipped with a capacitor unit constituted by an electrode plate and a diaphragm to receive an acoustic wave to be converted to an acoustic signal indicative of the acoustic wave.

The conventional electret condenser microphones of this type have so far been available for various audio equipments such as a cellular phone. One typical example of the conventional electret condenser microphones is exemplified and shown in FIGS. 8 and 9. The conventional electret condenser microphone 900 thus proposed comprises a casing member 910 in the form of a cylindrical shape, a circuit board 920 in the form of a circular shape and disposed in the casing member 910, and an electrically insulating member 930 in the form of an annular ring shape and provided on the circuit board 920.

The casing member 910 has an inlet portion 911, a side portion 912 integrally formed with the inlet portion 911 of the casing member 910, and an end portion 913 integrally formed with the side portion 912 of the casing member 910. The circuit board 920 has a peripheral portion 921 supported by the end portion 913 of the casing member 910, and a central portion 922 integrally formed with the peripheral portion 921 of the circuit board 920 and radially inwardly extending from the peripheral portion 921 of the circuit board 920. The circuit board 920 has thereon a printed wiring. The electrically insulating member 930 is formed with a plurality of guide holes 934.

The conventional electret condenser microphone 900 further comprises an electrode plate 940 in the form of a circular shape and mounted on the electrically insulating member 930, and a plurality of electrically connecting members 950 each intervening between the circuit board 920 and the electrode plate 940 to have the circuit board 920 and the electrode plate 940 electrically connected with each other. The electrode plate 940 has thereon an electret film.

Each of the electrically connecting members 950 is in the form of a column shape and embedded in the electrically insulating member 930 under the state that each of the electrically connecting members 950 is received in each of the guide holes 934 of the electrically insulating member 930. Each of the electrically connecting members 950 has a first surface 950*a* held in contact with the electrode plate 940, and a second surface 950*b* held in contact with the printed circuit board 120.

The conventional electret condenser microphone 900 further comprises a diaphragm supporting member 960 in the form of an annular ring shape and provided on the inlet portion 911 of the casing member 910, and a diaphragm 970 in the form of a circular shape and disposed along the electrode plate 940 to be spaced apart from the electrode plate 940 at a predetermined space distance.

The diaphragm 970 has a peripheral portion 971 supported by the diaphragm supporting member 960, and a central portion 972 integrally formed with the peripheral portion 971 of the diaphragm 970 and radially inwardly extending from the peripheral portion 971 of the diaphragm 970 to be oscillatable with respect to the casing member 910.

The conventional electret condenser microphone 900 further comprises an electrically insulating spacer 980 in the form of an annular ring shape and intervening between the electrode plate 940 and the diaphragm 970 to have the electrode plate 940 and the diaphragm 970 spaced apart from each other at a predetermined space distance.

The electrode plate 940 and The diaphragm 970 collectively constitutes a capacitor unit 902 to generate an electrical capacitance corresponding to the space distance between the electrode plate 940 and the diaphragm 970 under the state that the acoustic wave is transmitted to the diaphragm 970 to have the central portion 972 of the diaphragm 970 oscillated with respect to the casing member 910.

The conventional electret condenser microphone 900 further comprises a covering member 982 in the form of a circular shape and provided on the inlet portion 911 of the casing member 910. The inlet portion 911 of the casing member 910 is formed with an acoustic aperture 918 to have the acoustic wave transmitted to the diaphragm 970 through the covering member 982 and the acoustic aperture 918 of the inlet portion 911 of the casing member 910.

The conventional electret condenser microphone 900 further comprises a signal converting unit 990 designed to convert the electrical capacitance generated by the capacitor unit 902 to the acoustic signal indicative of the acoustic wave transmitted to the diaphragm 970.

The signal converting unit 990 is provided on the circuit board 920 and surrounded by the electrically insulating member 930. The signal converting unit 990 includes a field effect transistor 991. The signal converting unit 990 is electrically connected to the electrode plate 940 through the printed wiring of the circuit board 920 and each of the electrically connecting members 950. The signal converting unit 990 is electrically connected to the diaphragm 970 through the printed wiring of the circuit board 920, the casing member 910 and the diaphragm supporting member 960.

The conventional electret condenser microphone, however, encounters such a problem that the conventional electret condenser microphone is complicated in assembly and thus expensive in production cost, resulting from the fact that each of the electrically connecting members is embedded in the electrically insulating member under the state that each of the electrically connecting members is received in each of the guide holes of the electrically insulating member.

SUMMARY OF THE INVENTION

It is, therefore, an object of the present invention to provide an electret condenser microphone which can be simple in assembly.

It is another object of the present invention to provide an electret condenser microphone which can be inexpensive in production cost.

In accordance with a first aspect of the present invention, there is provided an electret condenser microphone for receiving an acoustic wave to be converted to an acoustic signal indicative of said acoustic wave, comprising: a casing member, a circuit board disposed in the casing member and having a peripheral portion supported by the casing member, and a central portion integrally formed with the peripheral portion of the circuit board and radially inwardly extending from the peripheral portion of the circuit board; an electrically insulating member disposed on and along the peripheral portion of the circuit board, the electrically insulating member having an outer surface opposing and spaced apart from the casing member, and an inner surface defining a central opening; an electrode plate mounted on the electrically insulating member, a plurality of electrically connecting members each intervening between the circuit board and the electrode plate to have the circuit board and the electrode plate electrically connected with each other, each of the electrically connecting members having a first portion disposed along the inner surface of the electrically insulating member, a second portion integrally formed with the first portion and radially outwardly extending from one end of the first portion, and a third portion integrally formed with the first portion and radially outwardly extending from the other end of the first portion; and a diaphragm disposed along the electrode plate and spaced apart from the electrode plate at a predetermined space distance.

The electret condenser microphone may further comprises a signal converting unit for converting an electrical capacitance between the electrode plate and the diaphragm to the acoustic signal indicative of the acoustic wave transmitted to the diaphragm, the signal converting unit being disposed on the central portion of the circuit board. The electrically connecting members may be partly disposed on and along the peripheral portion of the circuit board.

The electrically insulating member may be formed with a plurality of guide grooves, and in which each of the electrically connecting members is received in each of the guide grooves of the electrically insulating member.

each of the electrically connecting members may be made of a metal plate having an elasticity.

In accordance with a second aspect of the present invention, there is provided a method of producing an electret condenser microphone which comprises a casing member, a circuit board disposed in the casing member, an electrically insulating member disposed on the circuit board, an electrode plate mounted on the electrically insulating member, a plurality of electrically connecting members each intervening between the circuit board and the electrode plate to have the circuit board and the electrode plate electrically connected with each other, and a diaphragm disposed along the electrode plate, the electrically insulating member having an outer surface opposing and spaced apart from the casing member, and an inner surface defining a central opening, each of the electrically connecting members having a first portion disposed along the inner surface of the electrically insulating member, a second portion integrally formed with the first portion and radially outwardly extending from one end of the first portion, and a third portion integrally formed with the first portion and radially outwardly extending from the other end of the first portion, the method comprising the steps of: preparing a metal sheet formed with a placement hole, the metal sheet having an inner portion enclosing the placement hole of the metal sheet, and a plurality of strip portions each integrally formed with the inner portion of the metal sheet and radially inwardly extending from the inner portion of the metal sheet; positioning the electrically insulating member in the placement hole of the metal sheet to have the electrically insulating member provided on the strip portions of the metal sheet; bending each of the strip portions of the metal sheet along the inner surface of the electrically insulating member to form the first and third portions of each of the electrically connecting members; and cutting each of the strip portions of the metal sheet along the outer surface of the electrically insulating member to form the second portion of each of the electrically connecting members.

In accordance with a thierd aspect of the present invention, there is provided an electret condenser microphone for receiving an acoustic wave to be converted to an acoustic signal indicative of said acoustic wave, comprising: a casing member having a center axis passing therethrough, the casing member having an inlet portion having first and second surfaces each held in perpendicular relationship to the center axis of the casing member, a side portion integrally formed with the inlet portion of the casing member and axially extending along the center axis of the casing member from the inlet portion of the casing member, and an end portion integrally formed with the side portion of the casing member and radially inwardly extending toward the center axis of the casing member from the side portion of the casing member, the side portion of the casing member having an inner surface connected to the second surface of the inlet portion of the casing member, a circuit board disposed in the casing member and having a peripheral portion supported by the end portion of the casing member, and a central portion integrally formed with the peripheral portion of the circuit board and radially inwardly extending from the peripheral portion of the circuit board; an electrically insulating member disposed on and along the peripheral portion of the circuit board, the electrically insulating member having a first surface opposing and spaced apart along the center axis of the casing member from the second surface of the inlet portion of the casing member, a second surface held in contact with the circuit board, an outer surface opposing and spaced apart from the inner surface of the side portion of the casing member, and an inner surface defining a central opening; an electrode plate mounted on the electrically insulating member, a plurality of electrically connecting members each intervening between the circuit board and the electrode plate to have the circuit board and the electrode plate electrically connected with each other, each of the electrically connecting members having a first portion disposed along the inner surface of the electrically insulating member and having a first end section close to the electrode plate and a second end section close to the circuit board, a second portion integrally formed with the first portion and radially outwardly extending from the first end section of the first portion to be provided on the electrode plate, and a third portion integrally formed with the first portion and radially outwardly extending from the second end section of the first portion to be provided on the circuit board, the second portion of each of the electrically connecting members having an end surface opposing and spaced apart from the inner surface of the side portion of the casing member, the third portion of each of the electrically connecting members having an end surface opposing and spaced apart from the inner surface of the side portion of the casing member, and a diaphragm disposed along the electrode plate and spaced apart along the center axis of the casing member from the electrode plate at a predetermined space distance.

BRIEF DESCRIPTION OF THE DRAWINGS

The features and advantages of an electret condenser microphone according to the present invention will be more clearly understood from the following description taken in conjunction with the accompanying drawings in which.

DESCRIPTION OF THE PREFERRED EMBODIMENTS

Figure 1:
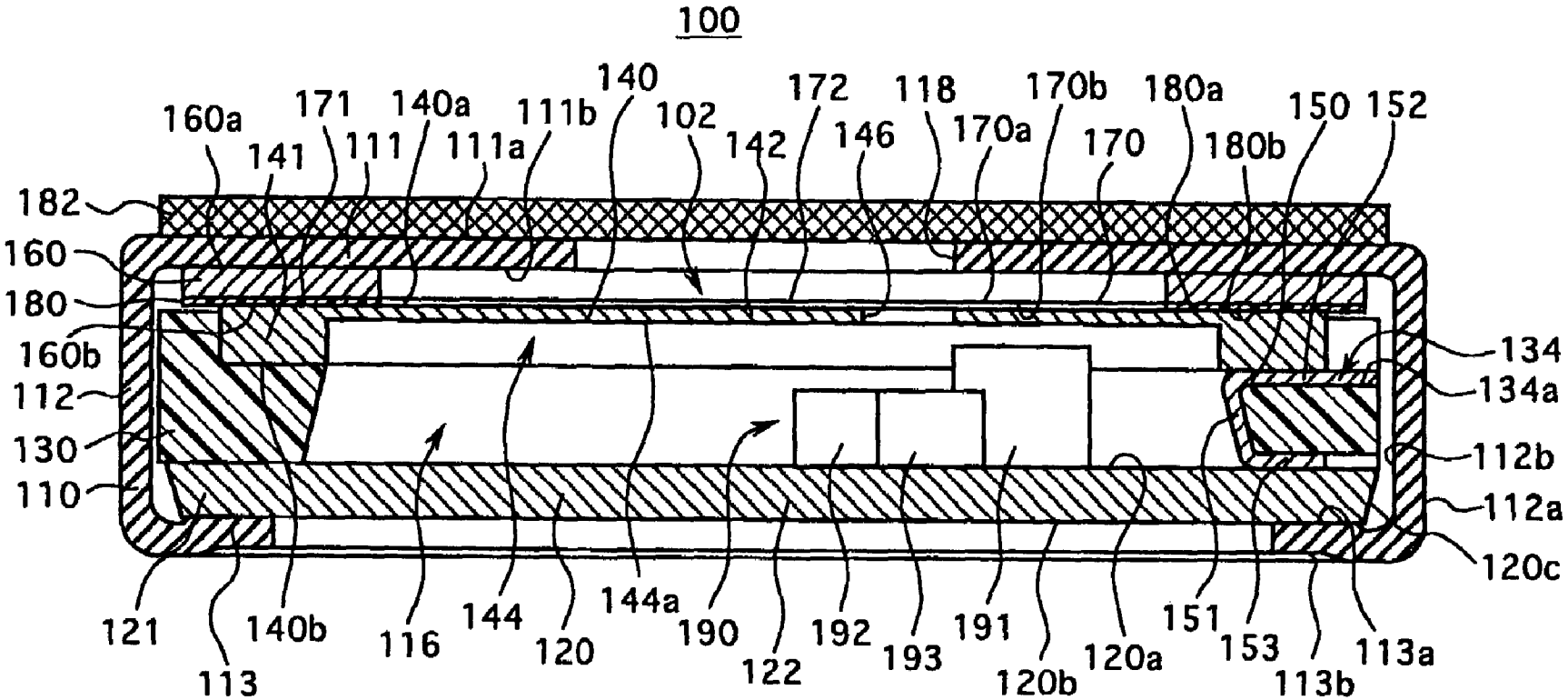
FIG. 1 is a cross-sectional view of one preferred embodiment of an electret condenser microphone according to the present invention.
Figure 2:
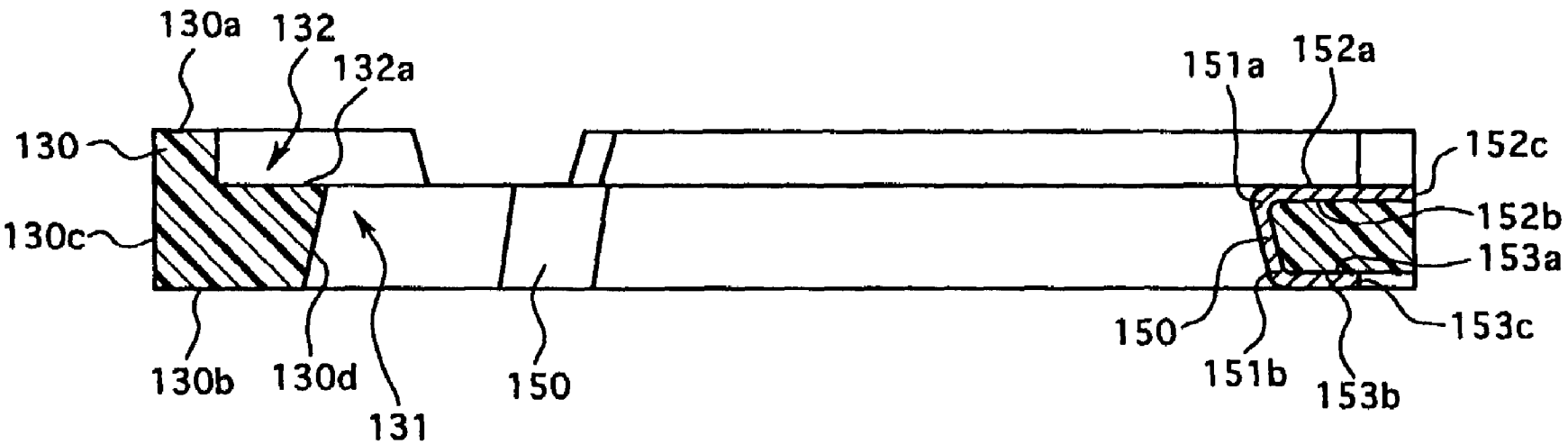
FIG. 2 is a cross-sectional view of an electrically insulating member and a plurality of electrically connecting members each forming part of the electret condenser microphone shown in FIG. 1.
Figure 3:
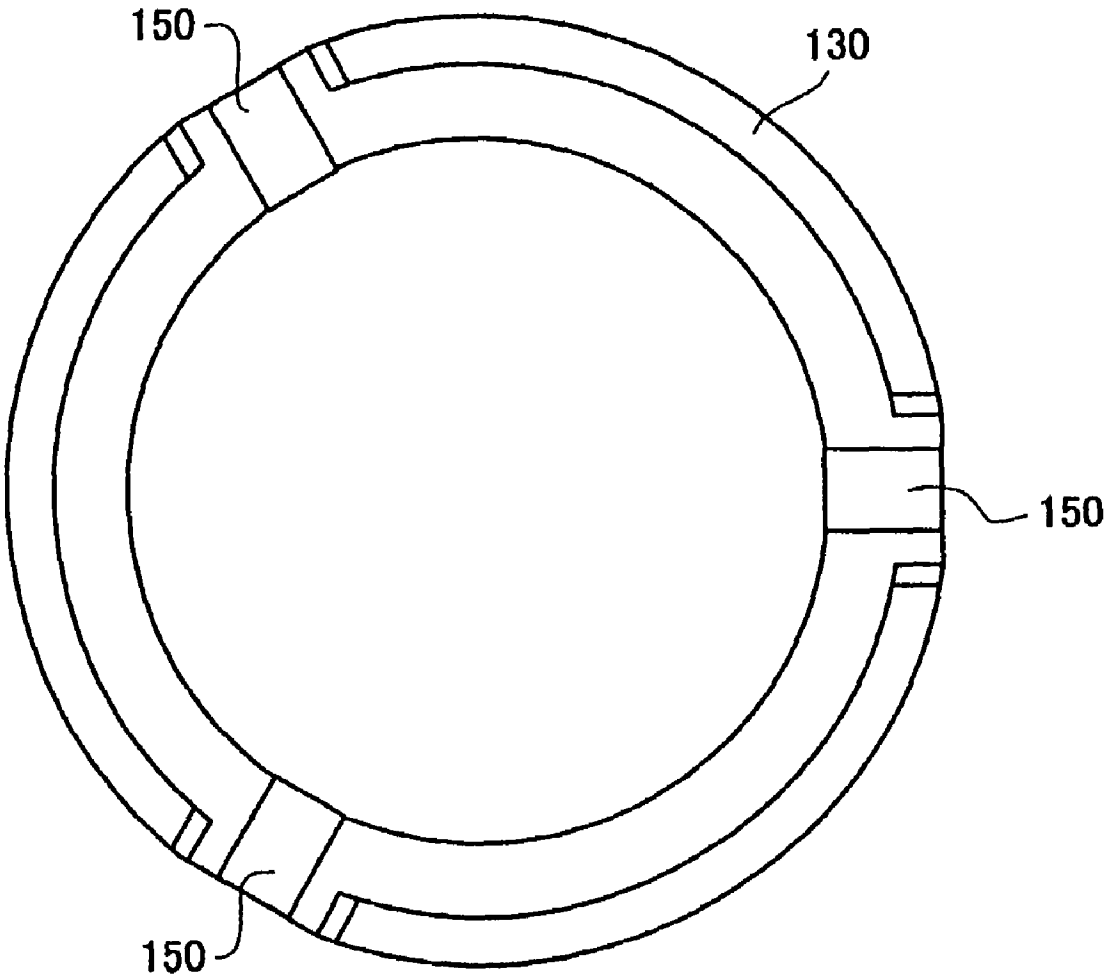
FIG. 3 is a plan view of the electrically insulating member and the electrically connecting members shown in FIG. 2.

One of the preferred embodiments of the electret condenser microphone according to the present invention will now be described in detail in accordance with the accompanying drawings.

Referring now to the drawings, in particular to FIGS. 1 to 7, there is shown one of preferred embodiments of the electret condenser microphone according to the present invention. The electret condenser microphone 100 is designed to receive an acoustic wave to be converted to an acoustic signal indicative of the acoustic wave. The electret condenser microphone 100 comprises a casing member 110 in the form of a cylindrical shape and having a center axis passing therethrough.

The casing member 110 has an inlet portion 111 having first and second surfaces 111*a* and 111*b* each held in perpendicular relationship to the center axis of the casing member 110, a side portion 112 integrally formed with the inlet portion 111 of the casing member 110 and axially extending along the center axis of the casing member 110 from the inlet portion 111 of the casing member 110, and an end portion 113 integrally formed with the side portion 112 of the casing member 110 and radially inwardly extending toward the center axis of the casing member 110 from the side portion 112 of the casing member 110. The casing member 110 is made of an electrically conductive material.

The side portion 112 of the casing member 110 has an outer surface 112*a* connected to the first surface 111*a* of the inlet portion 111 of the casing member 110, and an inner surface 112*b* connected to the second surface 111*b* of the inlet portion 111 of the casing member 110. The end portion 113 of the casing member 110 has a first surface 113*a* connected to the inner surface 112*b* of the side portion 112 of the casing member 110, and a second surface 113*b* connected to the outer surface 112*a* of the side portion 112 of the casing member 110. The second surface 111*b* of the inlet portion 111 of the casing member 110, the inner surface 112*b* of the side portion 112 of the casing member 110, the first surface 113*a* of the end portion 113 of the casing member 110, and the plane flush with the first surface 113*a* of the end portion 113 of the casing member 110 collectively defining a casing space 116 in the form of a cylindrical shape.

The electret condenser microphone 100 further comprises a circuit board 120 in the form of a circular shape and having a center axis held in coaxial relationship with the center axis of the casing member 110. The circuit board 120 is disposed in the casing member 110 and provided on the first surface 113*a* of the end portion 113 of the casing member 110. The circuit board 120 has a peripheral portion 121 supported by the end portion 113 of the casing member 110, and a central portion 122 integrally formed with the peripheral portion 121 of the circuit board 120 and radially inwardly extending from the peripheral portion 121 of the circuit board 120.

The circuit board 120 has a first surface 120*a* opposing and spaced apart along the center axis of the casing member 110 from the second surface 111*b* of the inlet portion 111 of the casing member 110, a second surface 120*b* held in contact with the first surface 113*a* of the end portion 113 of the casing member 110, and a peripheral surface 120*c* opposing and spaced apart from the inner surface 112*b* of the side portion 112 of the casing member 110. Each of the first and second surfaces 120*a* and 120*b* of the circuit board 120 has thereon a printed wiring.

The electret condenser microphone 100 further comprises an electrically insulating member 130 in the form of an annular ring shape and having a center axis held in coaxial relationship with the center axis of the casing member 110. The electrically insulating member 130 is provided on the first surface 120*a* of the circuit board 120 and disposed on and along the peripheral portion 121 of the circuit board 120. The electrically insulating member 130 has a first surface 130*a* opposing and spaced apart along the center axis of the casing member 110 from the second surface 111*b* of the inlet portion 111 of the casing member 110, a second surface 130*b* held in contact with the first surface 120*a* of the circuit board 120, an outer surface 130*c* opposing and spaced apart from the inner surface 112*b* of the side portion 112 of the casing member 110, and an inner surface 130*d* defining a central opening 131.

The inner surface 130*d* of the electrically insulating member 130 is in the form of a truncated conical shape and tapered toward the second surface 111*b* of the inlet portion 111 of the casing member 110. The first and inner surfaces 130*a* and 130*d* of the electrically insulating member 130 are connected with each other to collectively define an inner corner. The electrically insulating member 130 is formed at the inner corner of the electrically insulating member 130 with an annular ledge 132 and has an annular surface 132*a* forming part of the annular ledge 132 of the electrically insulating member 130.

The electrically insulating member 130 is formed with a plurality of guide grooves 134 disposed around the center axis of the casing member 110 in equiangularly spaced relationship with each other. Each of the guide grooves 134 of the electrically insulating member 130 has a bottom surface 134*a* forming part of each of the guide grooves 134 of the electrically insulating member 130. The electrically insulating member 130 is made of an electrically insulating material.

The electret condenser microphone 100 further comprises an electrode plate 140 in the form of a circular shape and having a center axis held in coaxial relationship with the center axis of the casing member 110. The electrode plate 140 is mounted on the electrically insulating member 130. The electrode plate 140 has a peripheral portion 141 received in the annular ledge 132 of the electrically insulating member 130 and supported by the electrically insulating member 130, and a central portion 142 integrally formed with the peripheral portion 141 of the electrode plate 140 and radially inwardly extending from the peripheral portion 141 of the electrode plate 140.

The electrode plate 140 has a first surface 140*a* opposing and spaced apart along the center axis of the casing member 110 from the second surface 111*b* of the inlet portion 111 of the casing member 110, and a second surface 140*b* opposing and spaced apart along the center axis of the casing member 110 from the first surface 120*a* of the circuit board 120. The first surface 140*a* of the electrode plate 140 has thereon an electret film. The electrode plate 140 is formed with a central cavity 144 open at the second surface 140*b* of the electrode plate 140 and has a bottom surface 144*a* forming part of the central cavity 144 of the electrode plate 140. The electrode plate 140 is made of an electrically conductive material.

The electrically insulating member 130 intervenes between the circuit board 120 and the electrode plate 140 to have the first surface 120*a* of the circuit board 120 and the second surface 120*b* of the electrode plate 140 spaced apart from each other. The annular surface 132*a* of the electrically insulating member 130 is held in contact with the second surface 140*b* of the electrode plate 140.

The electret condenser microphone 100 further comprises a plurality of electrically connecting members 150 each intervening between the circuit board 120 and the electrode plate 140 to have the circuit board 120 and the electrode plate 140 electrically connected with each other. The electrically connecting members 150 are partly disposed on and along the peripheral portion 121 of the circuit board 120. The electrically connecting members 150 are disposed around the center axis of the casing member 110 in equiangularly spaced relationship with each other. Each of the electrically connecting members 150 is received in each of the guide grooves 134 of the electrically insulating member 130.

Each of the electrically connecting members 150 has a first portion 151 disposed along the inner surface 130*d* of the electrically insulating member 130 and having a first end section 151*a* close to the electrode plate 140 and a second end section 151*b* close to the circuit board 120, a second portion 152 integrally formed with the first portion 151 and radially outwardly extending from the first end section 151*a* of the first portion 151 to be provided on the second surface 140*b* of the electrode plate 140, and a third portion 153 integrally formed with the first portion 151 and radially outwardly extending from the second end section 151*b* of the first portion 151 to be provided on the first surface 120*a* of the circuit board 120.

The second portion 152 of each of the electrically connecting members 150 has a first surface 152*a* held in contact with the second surface 140*b* of the electrode plate 140, a second surface 152*b* held in contact with the bottom surface 134*a* of each of the guide grooves 134 of the electrically insulating member 130, and an end surface 152*c* opposing and spaced apart from the inner surface 112*b* of the side portion 112 of the casing member 110. The first surface 152*a* of the second portion 152 of each of the electrically connecting members 150 is flush with the annular surface 132*a* of the electrically insulating member 130.

The third portion 153 of each of the electrically connecting members 150 has a first surface 153*a* held in contact with the bottom surface 134*a* of each of the guide grooves 134 of the electrically insulating member 130, a second surface 153*b* held in contact with the first surface 120*a* of the circuit board 120, and an end surface 153*c* opposing and spaced apart from the inner surface 112*b* of the side portion 112 of the casing member 110. The second surface 153*b* of the third portion 153 of each of the electrically connecting members 150 is flush with the second surface 130*b* of the electrically insulating member 130.

The second surface 152*b* of the second portion 152 of each of the electrically connecting members 150 and the first surface 153*a* of the third portion 153 of each of the electrically connecting members 150 are spaced apart from each other to have the electrically insulating member 130 interposed between the second and third portions 152 and 153 of each of the electrically connecting members 150.

The space distance between the end surface 152*c* of the second portion 152 of each of the electrically connecting members 150 and the inner surface 112*b* of the side portion 112 of the casing member 110 is smaller than or equal to the space distance between the outer surface 130*c* of the electrically insulating member 130 and the inner surface 112*b* of the side portion 112 of the casing member 110.

The space distance between the end surface 153*c* of the third portion 153 of each of the electrically connecting members 150 and the inner surface 112*b* of the side portion 112 of the casing member 110 is larger than or equal to the space distance between the outer surface 130*c* of the electrically insulating member 130 and the inner surface 112*b* of the side portion 112 of the casing member 110.

Each of the electrically connecting members 150 is made of a metal plate having an elasticity. Each of the electrically connecting members 150 is elastically restorable along the center axis of the casing member 110 to ensure that each of the electrically connecting members 150 is held in contact with the circuit board 120 and the electrode plate 140 with a sufficiently large contact pressure.

While the electret condenser microphone 100 has been described in the above as comprising three electrically connecting members 150, the three electrically connecting members 150 may be replaced by other numbers of electrically connecting members according to the present invention.

Though it has been described in the above that the space distance between the end surface 152*c* of the second portion 152 of each of the electrically connecting members 150 and the inner surface 112*b* of the side portion 112 of the casing member 110 is smaller than or equal to the space distance between the outer surface 130*c* of the electrically insulating member 130 and the inner surface 112*b* of the side portion 112 of the casing member 110, and the space distance between the end surface 153*c* of the third portion 153 of each of the electrically connecting members 150 and the inner surface 112*b* of the side portion 112 of the casing member 110 is larger than or equal to the space distance between the outer surface 130*c* of the electrically insulating member 130 and the inner surface 112*b* of the side portion 112 of the casing member 110, the space distance between the end surface 152*c* of the second portion 152 of each of the electrically connecting members 150 and the inner surface 112*b* of the side portion 112 of the casing member 110 may be larger than or equal to the space distance between the outer surface 130*c* of the electrically insulating member 130 and the inner surface 112*b* of the side portion 112 of the casing member 110, and the space distance between the end surface 153*c* of the third portion 153 of each of the electrically connecting members 150 and the inner surface 112*b* of the side portion 112 of the casing member 110 may be smaller than or equal to the space distance between the outer surface 130*c* of the electrically insulating member 130 and the inner surface 112*b* of the side portion 112 of the casing member 110.

The electret condenser microphone 100 further comprises a diaphragm supporting member 160 in the form of an annular ring shape and having a center axis held in coaxial relationship with the center axis of the casing member 110. The diaphragm supporting member 160 is provided on the second surface 111*b* of the inlet portion 111 of the casing member 110. The diaphragm supporting member 160 has a first surface 160*a* held in contact with the second surface 111*b* of the inlet portion 111 of the casing member 110, and a second surface 160*b* opposing and spaced apart along the center axis of the casing member 110 from the first surface 120*a* of the circuit board 120. The diaphragm supporting member 160 is made of an electrically conductive material.

The electret condenser microphone 100 further comprises a diaphragm 170 in the form of a circular shape and having a center axis held in coaxial relationship with the center axis of the casing member 110. The diaphragm 170 is disposed along the electrode plate 140. The diaphragm 170 has a peripheral portion 171 supported by the diaphragm supporting member 160, and a central portion 172 integrally formed with the peripheral portion 171 of the diaphragm 170 and radially inwardly extending from the peripheral portion 171 of the diaphragm 170 to be oscillatable along the center axis of the casing member 110 with respect to the casing member 110.

The diaphragm 170 has a first surface 170*a* opposing and spaced apart along the center axis of the casing member 110 from the second surface 111*b* of the inlet portion 111 of the casing member 110, and a second surface 170*b* opposing and spaced apart along the center axis of the casing member 110 from the first surface 140*a* of the electrode plate 140 at a predetermined space distance. The diaphragm 170 is made of an electrically conductive material.

The diaphragm supporting member 160 intervenes between the inlet portion 111 of the casing member 110 and the diaphragm 170 to have the second surface 111*b* of the inlet portion 111 of the casing member 110 and the first surface 170*a* of the diaphragm 170 spaced apart from each other. The central portion 142 of the electrode plate 140 is formed with a through bore 146 open at the first and bottom surfaces 140*a* and 144*a* of the electrode plate 140. The electrode plate 140 allows the passage of the air through the through bore 146 of the electrode plate 140 to ensure that the central portion 172 of the diaphragm 170 is oscillatable along the center axis of the casing member 110 with respect to the casing member 110.

The electret condenser microphone 100 further comprises an electrically insulating spacer 180 in the form of an annular ring shape and intervening between the electrode plate 140 and the diaphragm 170 to have the first surface 140*a* of the electrode plate 140 and the second surface 170*b* of the diaphragm 170 spaced apart from each other at a predetermined space distance. The electrically insulating spacer 180 has a first surface 180*a* held in contact with the second surface 170*b* of the diaphragm 170, and a second surface 180*b* held in contact with the first surface 140*a* of the electrode plate 140. The electrically insulating spacer 180 is made of an electrically insulating material.

The electrode plate 140 and the diaphragm 170 collectively constitutes a capacitor unit 102 to generate an electrical capacitance corresponding to the space distance between the first surface 140*a* of the electrode plate 140 and the second surface 170*b* of the diaphragm 170 under the state that the acoustic wave is transmitted to the diaphragm 170 to have the central portion 172 of the diaphragm 170 oscillated along the center axis of the casing member 110 with respect to the casing member 110.

The electret condenser microphone 100 further comprises a covering member 182 in the form of a circular shape and provided on the first surface of the inlet portion 111 of the casing member 110. The covering member 182 is made of a cloth. The inlet portion 111 of the casing member 110 is formed with an acoustic aperture 118 open at the first and second surfaces 111*a* and 111*b* of the inlet portion 111 of the casing member 110 to have the acoustic wave transmitted to the diaphragm 170 through the covering member 182 and the acoustic aperture 118 of the inlet portion 111 of the casing member 110.

The electret condenser microphone 100 further comprises a signal converting unit 190 designed to convert the electrical capacitance generated by the capacitor unit 102 to the acoustic signal indicative of the acoustic wave transmitted to the diaphragm 170. The signal converting unit 190 is provided on the first surface 120*a* of the circuit board 120 and disposed on the central portion 122 of the circuit board 120. The signal converting unit 190 is surrounded by the inner surface 130*d* of the electrically insulating member 130.

The signal converting unit 190 includes a field effect transistor 191, a chip capacitor 192, and a chip resistor 193. The signal converting unit 190 is electrically connected to the electrode plate 140 through the printed wiring of the first surface 120*a* of the circuit board 120 and each of the electrically connecting members 150. The signal converting unit 190 is electrically connected to the diaphragm 170 through the printed wiring of the second surface 120*b* of the circuit board 120, the casing member 110 and the diaphragm supporting member 160.

The circuit board 120, the electrically insulating member 130, the electrode plate 140, the electrically connecting members 150, the diaphragm supporting member 160, the diaphragm 170, the electrically insulating spacer 180 and the signal converting unit 190 are accommodated in the casing space 116 of the casing member 110.

The following description will be directed to a method of producing the electret condenser microphone 100 with reference to the drawings shown in FIGS. 4 to 7. The constructions of the casing member 110, the circuit board 120, the electrically insulating member 130, the electrode plate 140, the electrically connecting members 150, the diaphragm supporting member 160, the diaphragm 170, the electrically insulating spacer 180, the covering member 182 and the signal converting unit 190 have been described in the above as will be seen in FIGS. 1 to 3. The method of producing the electret condenser microphone 100 is performed through the steps including a preparing step, a positioning step, a bending step, a cutting step and a installing step as follows.

Figure 4:
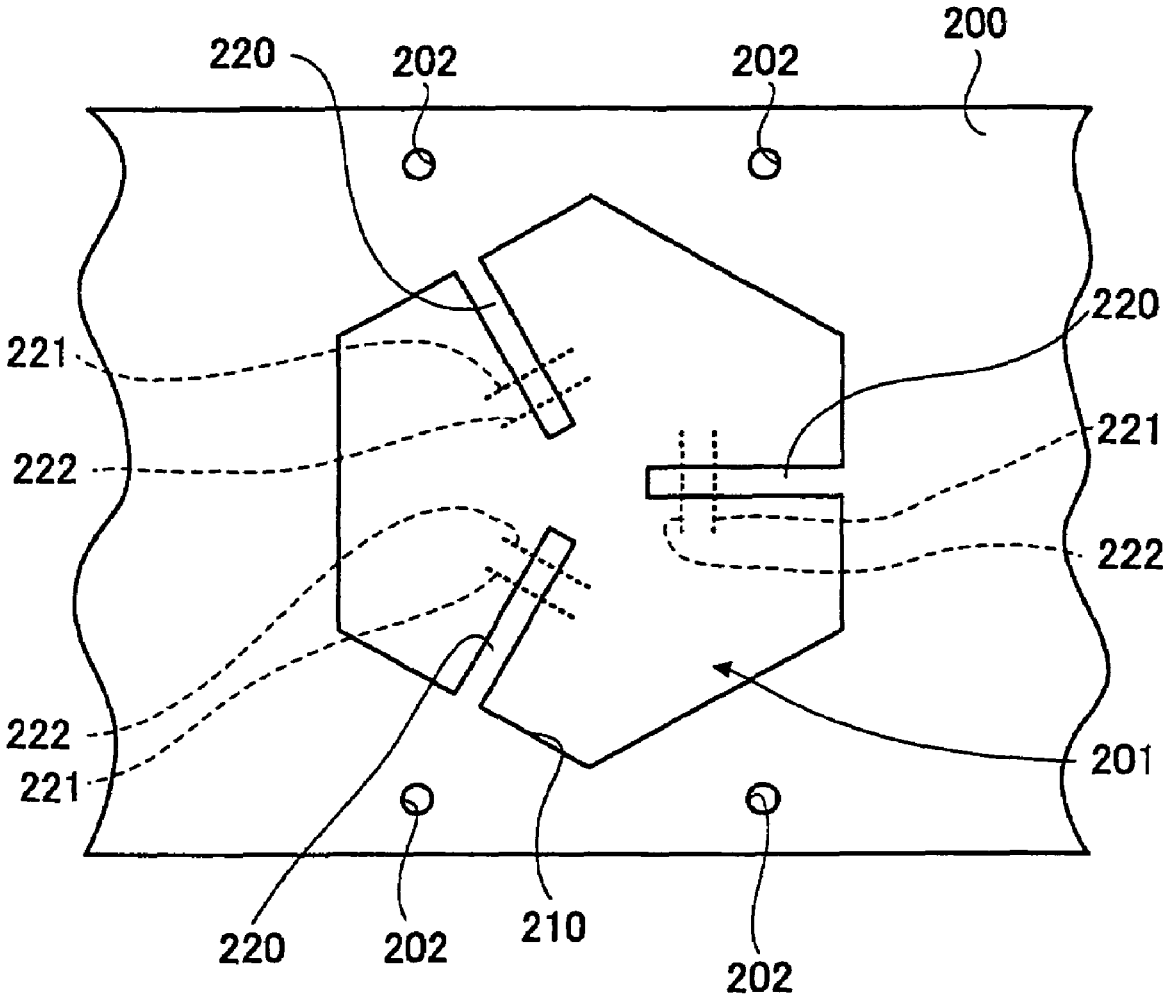
FIG. 4 is a plan view of a metel sheet which is prepared to form a plurality of electrically connecting members forming part of the electret condenser microphone shown in FIG. 1.
Figure 7:
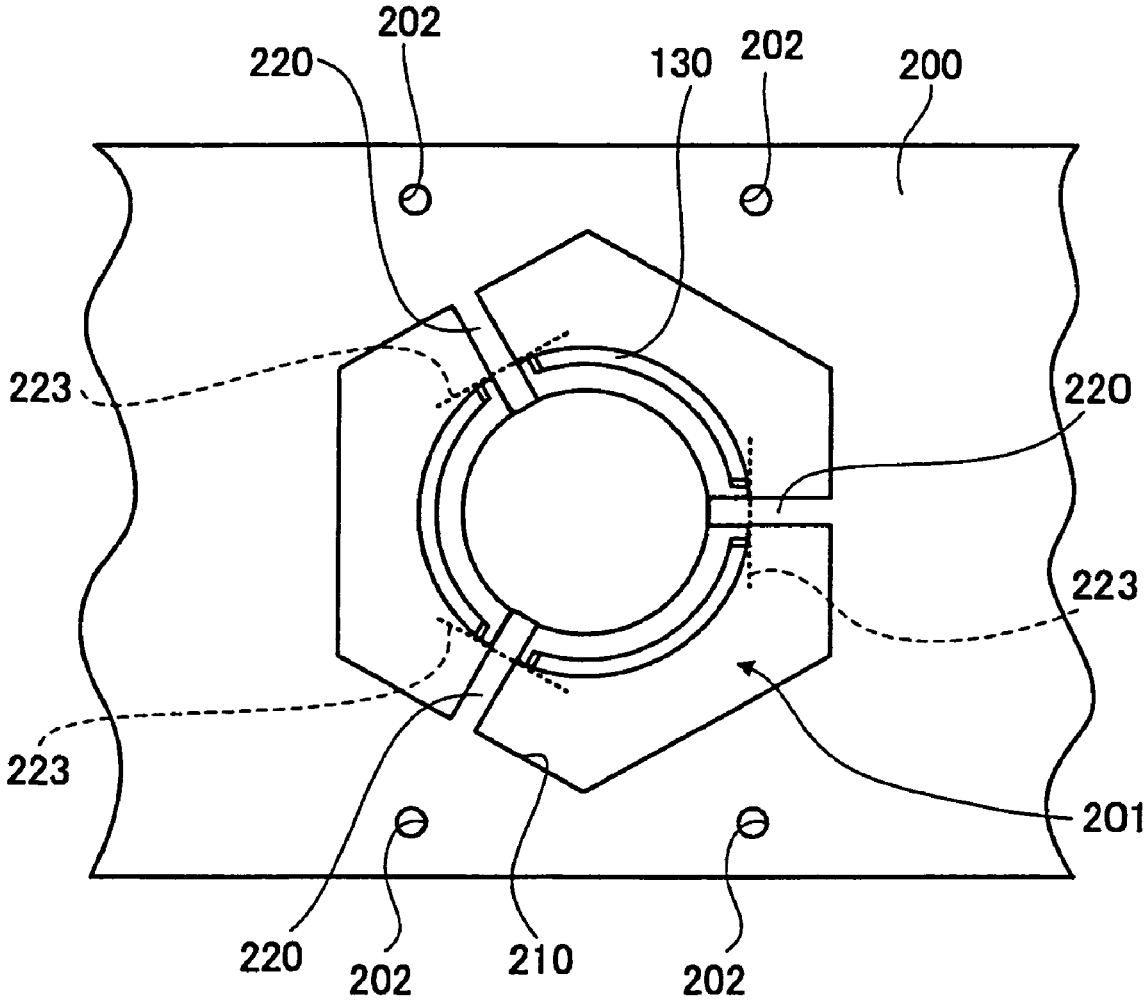
FIG. 7 is a plan view similar to FIG. 6 but showing a cutting step of a method of producing the electret condenser microphone shown in FIG. 1.
Figure 8:
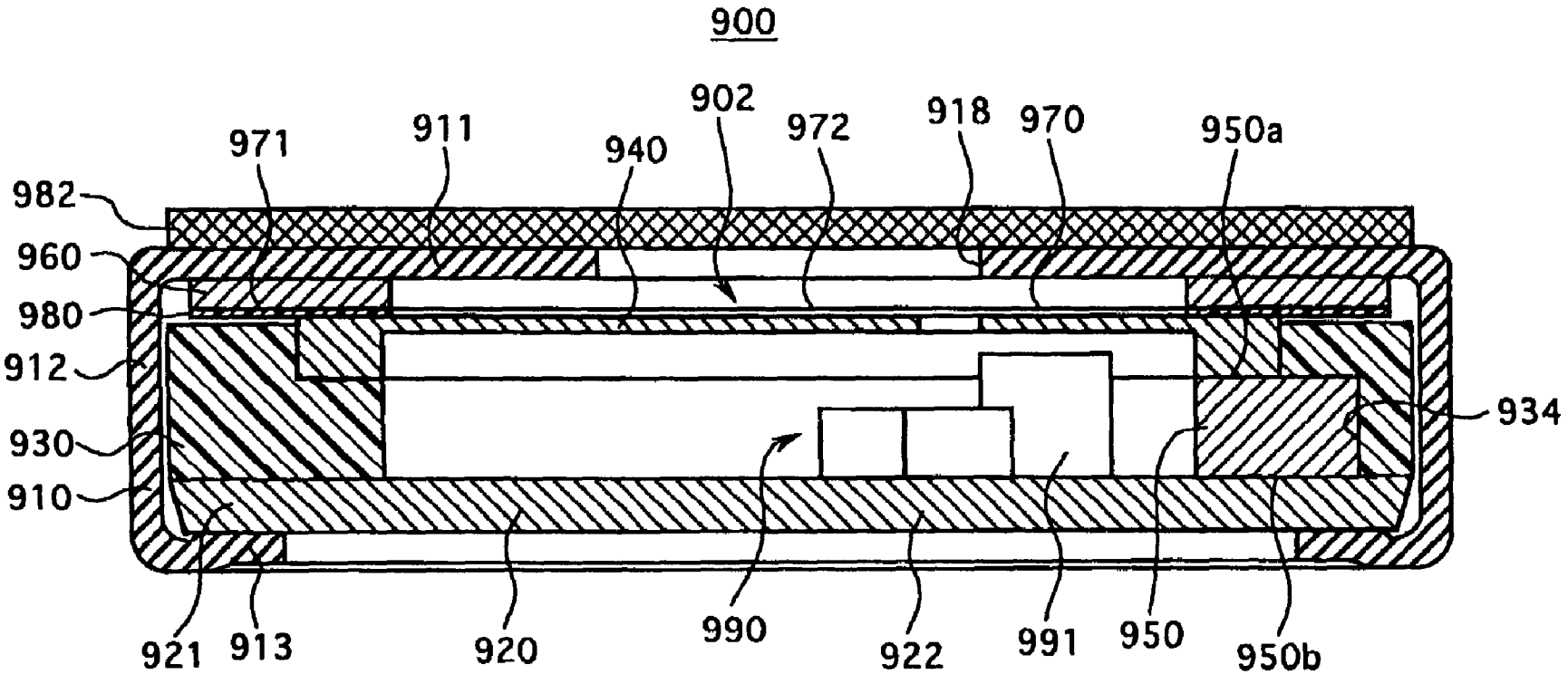
FIG.8 PRIOR ART
FIG. 8 is a cross-sectional view of a conventional electret condenser microphone.
Figure 9:
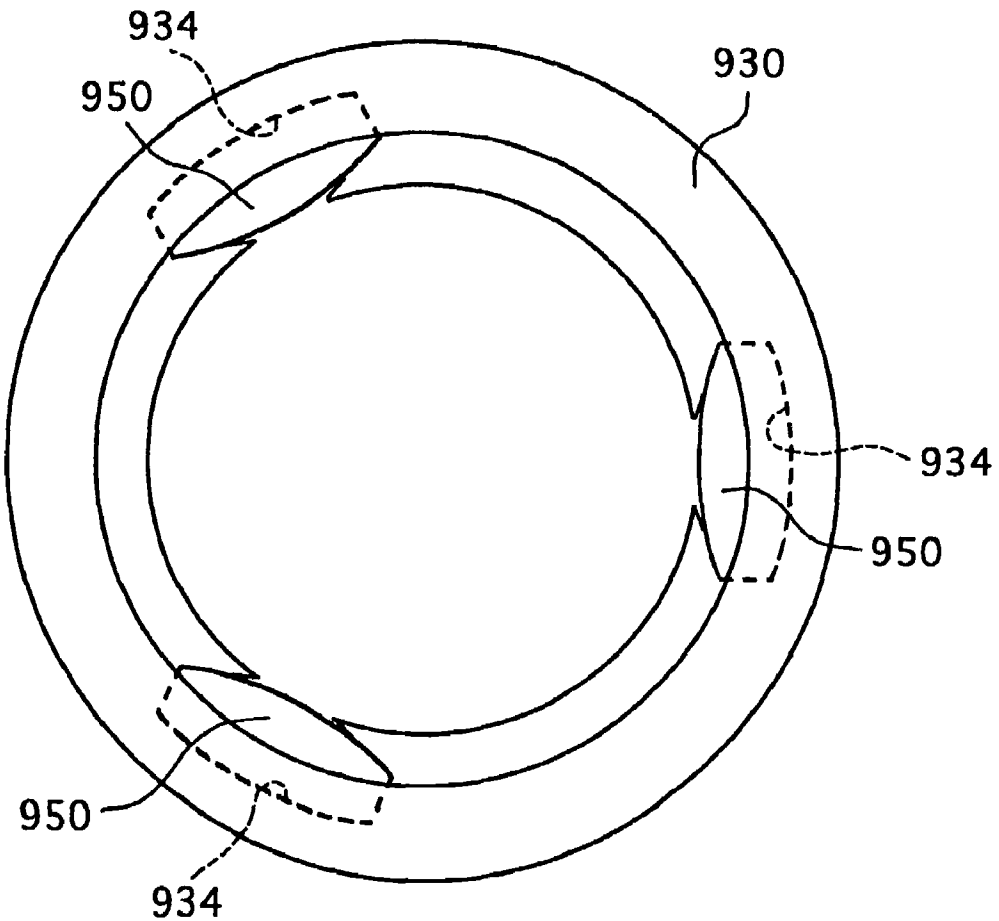
FIG.9 PRIOR ART
FIG. 9 is a plan view of an electrically insulating member and a plurality of electrically connecting members each forming part of the conventional electret condenser microphone shown in FIG. 8.

In the preparing step, a metal sheet 200 made of an electrically conductive material is prepared as shown in FIG. 4. The metal sheet 200 is worked through stamping, etching and so on to be formed with a placement hole 201 and a plurality of positioning holes 202. The metal sheet 200 has an inner portion 210 enclosing the placement hole 201 of the metal sheet 200, and a plurality of strip portions 220 each integrally formed with the inner portion 210 of the metal sheet 200 and radially inwardly extending from the inner portion 210 of the metal sheet 200. The positioning holes 202 of the metal sheet 200 are disposed around the placement hole 201 of the metal sheet 200 with a predetermined pitch. The positioning holes 202 of the metal sheet 200 are designed to position the electrically insulating member 130 to the placement hole 201 of the metal sheet 200. Each of the strip portions 220 of the metal sheet 200 has first and second bending lines 221 and 222 as shown in FIG. 4, and a cutting line 223 as shown in FIG. 7.

Figure 5:
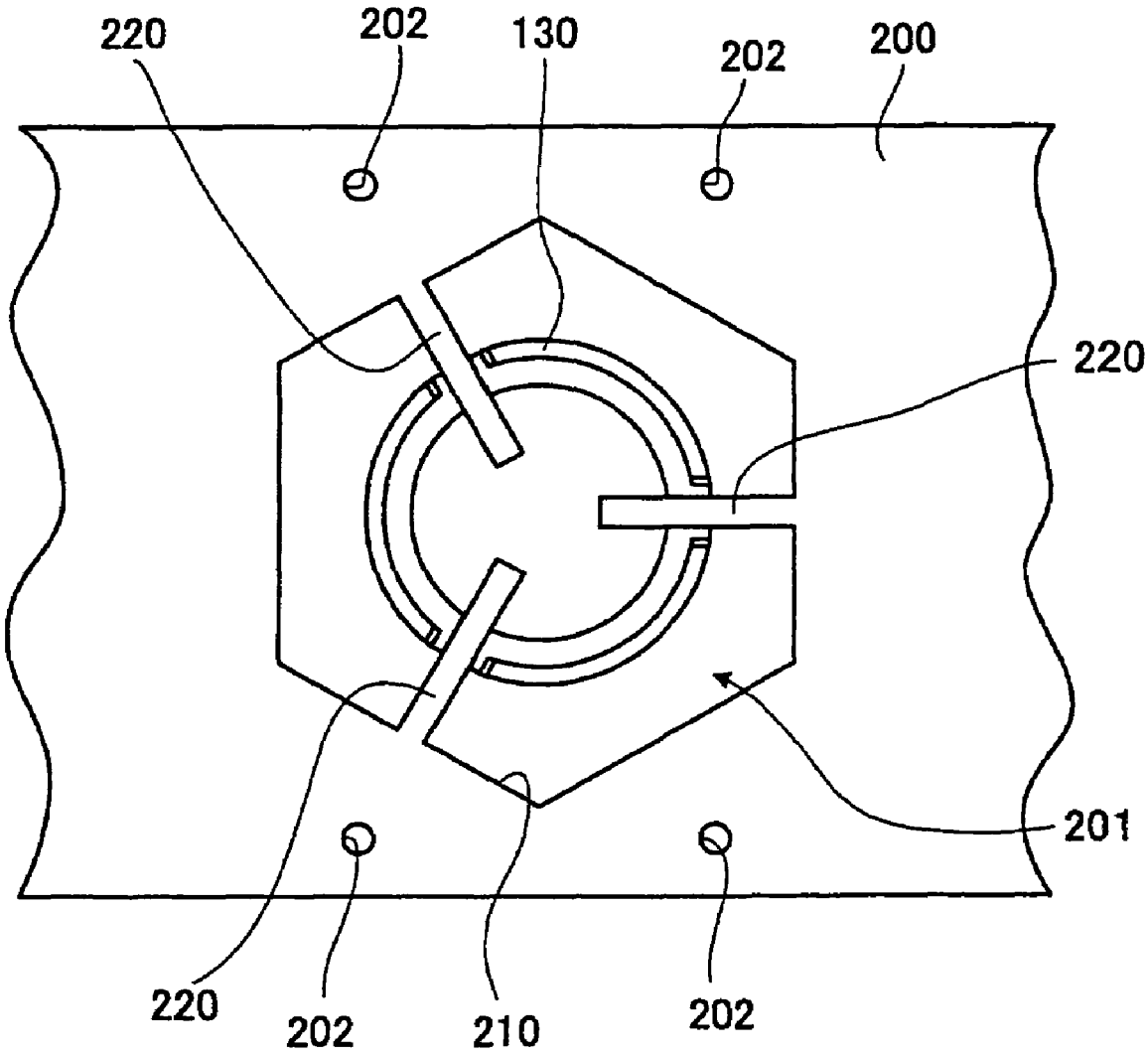
FIG. 5 is a plan view similar to FIG. 4 but showing a positioning step of a method of producing the electret condenser microphone shown in FIG. 1.
Figure 6:
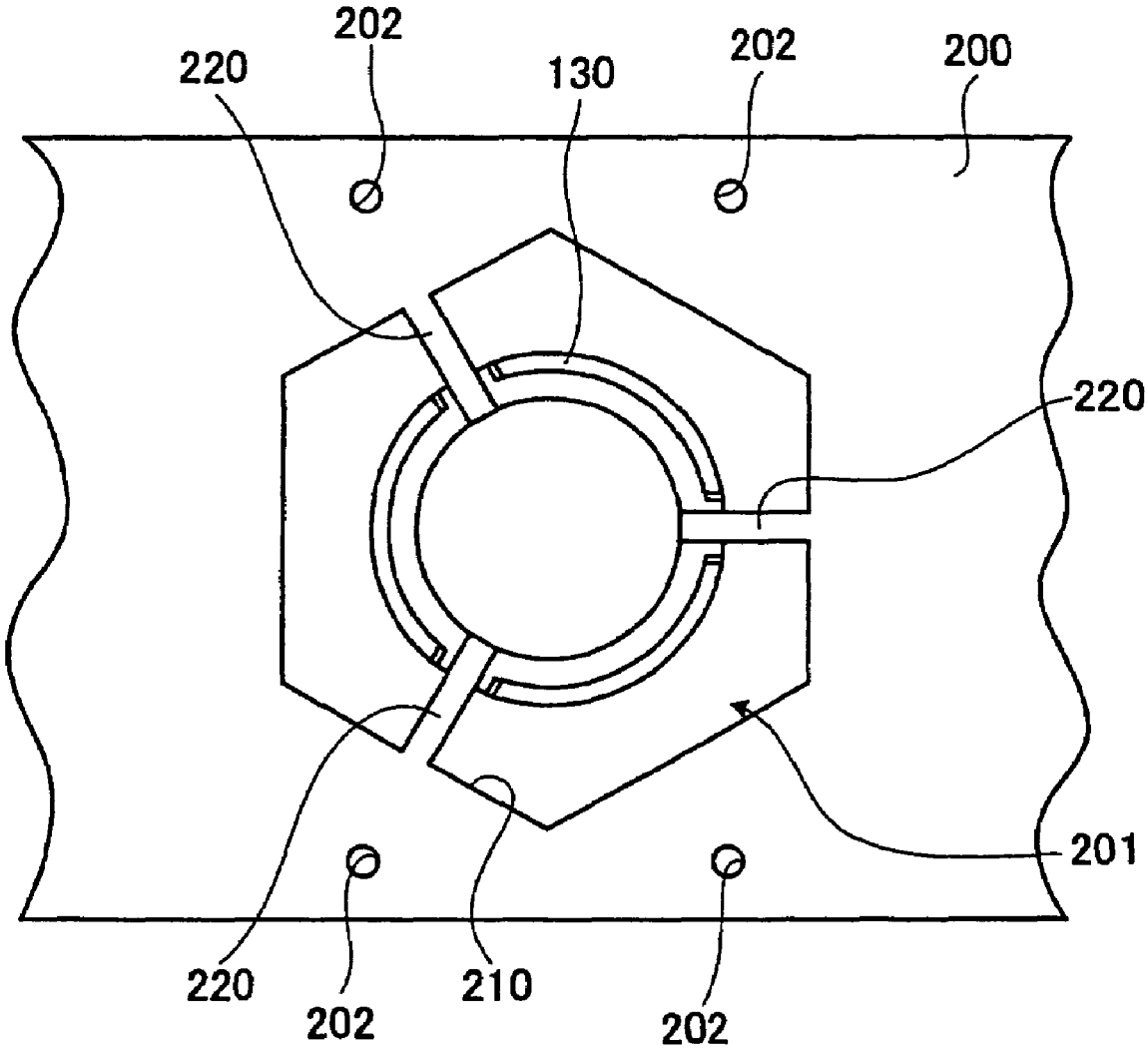
FIG. 6 is a plan view similar to FIG. 5 but showing a bending step of a method of producing the electret condenser microphone shown in FIG. 1.

In the positioning step, the electrically insulating member 130 is positioned in the placement hole 201 of the metal sheet 200 through the use of the positioning holes 202 of the metal sheet 200 to have the electrically insulating member 130 provided on the strip portions 220 of the metal sheet 200 as shown in FIG. 5.

In the bending step, each of the strip portions 220 of the metal sheet 200 is bent at the first and second bending lines 221 and 222 of each of the strip portions 220 of the metal sheet 200 along the inner surface 130*d* of the electrically insulating member 130 to form the first and third portions 151 and 153 of each of the electrically connecting member 150.

In the cutting step, each of the strip portions 220 of the metal sheet 200 is cut at the cutting line 223 of each of the strip portions 220 of the metal sheet 200 along the outer surface 130*c* of the electrically insulating member 130 to form the second portion 152 of each of the electrically connecting member 150.

In the installing step, the electrically insulating member 130 equipped with the electrically connecting members 150 is installed between the circuit board 120 of the electrode plate 140. The electret condenser microphone 100 is then produced as shown in FIG. 1.

As will be seen from the foregoing description, it is to be understood that the electret condenser microphone according to the present invention makes it possible 1) to be simple in assembly, 2) to be appropriate for automatic production, and 3) to be inexpensive in production cost, resulting from the fact that each of the electrically connecting members has a first portion disposed along the inner surface of the electrically insulating member, a second portion integrally formed with the first portion and radially outwardly extending from one end of the first portion, and a third portion integrally formed with the first portion and radially outwardly extending from the other end of the first portion.

While the present invention has thus been shown and described with reference to the specific embodiments, however, it should be noted that the invention is not limited to the details of the illustrated structures but changes and modifications may be made without departing from the scope of the appended claims.

What is claimed:

1. A method of producing an electret condenser microphone which comprises a casing member, a circuit board disposed in said casing member, an electrically insulating member disposed on said circuit board, an electrode plate mounted on said electrically insulating member, a plurality of electrically connecting members each intervening between said circuit board and said electrode plate to have said circuit board and said electrode plate electrically connected with each other, and a diaphragm disposed along said electrode plate, said electrically insulating member having an outer surface opposing and spaced apart from said casing member, and an inner surface defining a central opening, each of said electrically connecting members having a first portion disposed along said inner surface of said electrically insulating member, a second portion integrally formed with said first portion and radially outwardly extending from one end of said first portion, and a third portion integrally formed with said first portion and radially outwardly extending from the other end of said first portion, said method comprising the steps of:

preparing a metal sheet formed with a placement hole, said metal sheet having an inner portion enclosing said placement hole of said metal sheet, and plurality of strip portions each integrally formed with said inner portion of said metal sheet and radially inwardly extending from said inner portion of said metal sheet;

positioning said electrically insulating member in said placement hole of said metal sheet to have said electrically insulating member provided on said strip portions of said metal sheet;

bending each of said strip portions of said metal sheet along said inner surface of said electrically insulating member to form said first and third portions of each of said electrically connecting members;

cutting each of said strip portions of said metal sheet along said outer surface of said electrically insulating member to form said second portion of each of said electrically connecting members; and installing said electrically insulating member equipped with said electrically connecting members between said circuit board and said electrode plate.

* * * * *